United States Patent [19]

Kulka et al.

[11] 4,077,916

[45] Mar. 7, 1978

[54] HEXYLOXYACETONITRILE PERFUME COMPOSITIONS

[75] Inventors: Kurt Kulka, New York; Teodosij Zazula, Rego Park, both of N.Y.; John M. Yurecko, Bayonne, N.J.

[73] Assignee: Fritzsche Dodge & Olcott Inc., New York, N.Y.

[21] Appl. No.: 786,657

[22] Filed: Apr. 11, 1977

Related U.S. Application Data

[63] Continuation-in-part of Ser. No. 693,750, Jun. 8, 1976, abandoned.

[51] Int. Cl.[2] ..... C11B 9/00

[52] U.S. Cl. ..... 252/522; 260/465.6; 260/614 R

[58] Field of Search ..... 252/522; 260/465.6, 260/614 R

[56] References Cited

U.S. PATENT DOCUMENTS

| | | | |
|---|---|---|---|
| 2,169,578 | 8/1939 | Bruson et al. | 260/465.6 |
| 2,280,790 | 4/1942 | Bruson | 260/465.6 |
| 3,132,179 | 5/1964 | Clarke | 260/614 R |
| 3,764,712 | 10/1973 | Kulka | 252/522 |
| 3,910,853 | 10/1975 | Kulka | 252/522 |
| 3,960,923 | 6/1976 | De Simone | 252/522 |

OTHER PUBLICATIONS

Kulka et al., American Perfumes and Cosmetics, 82, 29.–30, 1967.

*Primary Examiner*—Veronica O'Keefe
*Attorney, Agent, or Firm*—Frank M. Nolan

[57] ABSTRACT

The perfume compositions of this invention contain hexyloxyacetonitrile which contributes unique olfactory properties reminiscent of irone with a flowery, herbaceous by-note. Hexyloxyacetonitrile can be incorporated readily in a wide variety of perfume compositions to enhance, diffuse and prolong the odor characteristics of such compositions.

3 Claims, No Drawings

HEXYLOXYACETONITRILE PERFUME COMPOSITIONS

This application is a continuation-in-part application of the pending U.S. application Ser. No. 693,750 of Kulka et al., filed June 8, 1976 now abandoned.

This application relates to perfume compositions and particularly to perfume compositions containing hexyloxyacetonitrile.

Aldehydes having the structure:

$$R - O - CH_2 - CHO$$

in which R is an aliphatic, aromatic or cyclic group are useful as aromatic perfumery materials. (Kulka et al., American Perfumes and Cosmetics, Vol. 82, pp. 29–30, 1967). However, nitriles produced from such aldehydes hitherto have not been found useful as perfume materials. In accordance with this invention, perfume compositions are provided containing at least 0.1% by weight, desirably less than 10% by weight, and preferably 0.1 to 1% by weight of hexyloxyacetonitrile and at least 1% by weight of a perfume component which modifies the olfactory properties of the hexyloxyacetonitrile. The hexyloxyacetonitrile may be incorporated in the perfume composition in the form of a solution of dipropylene glycol. Desirably, the compositions of this invention contain at least 0.1% by weight of hexyloxyacetaldehyde dimethyl acetal.

The hexylocyacetonitrile utilized in the perfume compositions of this invention is unique in its olfactory properties. This nitrile has a flowery, herbaceous, slightly fatty odor reminiscent of irone. One of its outstanding characteristics is its "diffusing" odor. Thus it is readily perceived and recognizable even from a distance. Its lasting power as determined from a smelling blotter is limited to 7–8 hours. Accordingly, it can be used advantageously to give top-notes to perfume compositions. It blends well with other perfume components to improve and give "character" to the total odor-profile.

The hexyloxyacetonitrile may be used in a great variety of perfume compositions such as rose, jasmine, chypre, lavender and phantasy-bouquet. In such compositions it may be used in various concentrations to achieve a desired effect. Consequently, hexyloxyacetonitrile is a valuable addition to the arsenal of aroma chemicals.

The hexyloxyacetonitrile may be produced by the method described in U.S. Pat. No. 3,132,179 of Robert L. Clarke. Clarke employed the hexyloxyacetonitrile as a pharmaceutical intermediate.

The Clarke procedure for the production of hexyloxyacetonitrile involves a two-step method, chloromethylating n-hexanol to chloro-methyl-n-hexyl ether and reacting the ether with cuprous cyanide in accordance with the following reaction scheme:

$$CH_3-(CH_2)_5-OH + HCHO + HCl \rightarrow CH_3-(CH_2)_5-O-CH_2Cl \quad (I)$$

$$CH_3-(CH_2)_5-O-CH_2Cl + CUCN \rightarrow CH_3-(CH_2)_5-O-CH_2-CN + CuCl \quad (II)$$

Alternatively, the hexyloxyacetonitrile may be produced by liberating hexyloxyacetaldehyde from one of its acetals such as its dimethylacetal, reacting the hexyloxyacetaldehyde with hydroxylamine to obtain hexyloxyacetaldehyde oxime, and dehydrating the hexyloxyacetaldehyde oxime, for example, with acetic anhydride to obtain the hexyloxyacetonitrile.

The reaction scheme is as follows:

III.

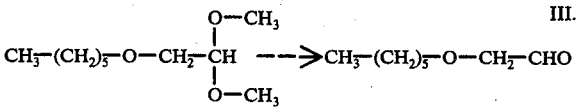

IV.

$$CH_3-(CH_2)_5-O-CH_2-CHO + NH_2OH \rightarrow CH_3-(CH_2)_5-O-CH_2-CH{=}NOH + H_2O$$

V.

$$CH_3-(CH_2)_5-O-CH_2-CH{=}NOH + (CH_3CO)_2O \rightarrow CH_3-(CH_2)_5-O-CH_2-CN + 2CH_3COOH$$

A more comprehensive understanding of this invention is obtained by reference to the following examples:

EXAMPLE I

MUGUET PERFUME COMPOSITION

A Muguet perfume composition is prepared by mixing together the following:

| Parts by Weight | |
|---|---|
| 25 | Benzyl Acetate |
| 30 | Linalool |
| 50 | Dimethyl Benzyl Carbinol |
| 20 | Linalyl Acetate |
| 20 | Citronellyl Acetate |
| 50 | Phenylethyl Alcohol |
| 50 | Citronellol |
| 40 | Heliotropin |
| 10 | Ylang Ylang Oil |
| 100 | Cinnamyl Acetate |
| 475 | Hydroxycitronellal |
| 75 | Cyclamal |
| 40 | Hexyloxyacetaldehyde Dimethyl Acetal |
| 10 | Hexyloxyacetonitrile (50% solution in dipropylene glycol) |
| 5 | Tetramethyl Ethyl Nitrile Tetralin [33% solution in dipropylene glycol (Nitrile Musk)] |
| 1000 | |

EXAMPLE II

CHYPRE PERFUME COMPOSITION

A Chypre perfume composition is prepared by mixing together the following:

| Parts by Weight | |
|---|---|
| 180 | Linalyl Acetate |
| 300 | 2,4-Dihydroxy-3-Methyl-Benzaldehyde [20% solution in dipropylene glycol (Oak Moss Aldehyde)] |
| 30 | Patchouly Oil |
| 30 | Phenylethyl Alcohol |
| 40 | Vetivert Oil |
| 50 | Clary Sage Oil |
| 50 | Methyl Ionone |
| 180 | Coumarin |
| 100 | Labdanum Resinoid |
| 20 | Eugenol |
| 10 | Hexyloxyacetaldehyde Dimethyl Acetal |
| 10 | Hexyloxyacetonitrile (50% solution in dipropylene glycol) |
| 1000 | |

EXAMPLE III

ROSE PERFUME COMPOSITION

A Rose perfume composition is prepared by mixing together the following:

| Parts by Weight | |
|---|---|
| 200 | Citronellol |
| 150 | Phenylethyl Alcohol |
| 200 | Geraniol Palmarose |
| 150 | Rhodinol |
| 50 | Guiac Wood Oil |
| 5 | Eugenol |
| 70 | Ionone α |
| 50 | Cinnamyl Acetate |
| 40 | Phenylethyl Acetate |
| 80 | Phenylacetaldehyde Propyleneglycol Acetal |
| 2 | Hexyloxyacetonitrile (50% solution in dipropylene glycol) |
| | Hexyloxyacetaldehyde Dimethyl Acetal |
| 1000 | |

EXAMPLE IV

ROSE PERFUME COMPOSITION

A Rose perfume composition is prepared by mixing together the following:

| Parts by Weight | |
|---|---|
| 200 | Phenylethyl Alcohol |
| 200 | Rhodinol |
| 300 | Ionone α |
| 100 | Geraniol |
| 50 | Citronellol |
| 25 | Dihydro-Iso-Jasmone |
| 25 | Hexyloxyacetaldehyde Dimethyl Acetal |
| 10 | Hexyloxyacetonitrile (50% solution in dipropylene glycol) |
| 80 | Phenylacetaldehyde Propylene Glycol Acetal |
| 10 | Tetramethyl Ethyl Nitrile Tetralin [33% solution in dipropylene glycol (Musk Nitrile)] |
| 1000 | |

EXAMPLE V

LILAC PERFUME COMPOSITION

A Lilac perfume composition is prepared by mixing together the following:

| Parts by Weight | |
|---|---|
| 450 | Terpineol α |
| 150 | Hydroxycitronellol |
| 150 | Heliotropin |
| 50 | Phenylethyl Alcohol |
| 70 | Benzyl Acetate |
| 100 | Anisic Aldehyde |
| 5 | Oil Cananga |
| 5 | Ionone α |

-continued

| Parts by Weight | |
|---|---|
| 10 | Dihydro-Iso-Jasmone |
| 5 | Hexyloxyacetonitrile (50% solution in dipropylene glycol) |
| 3 | Tetramethyl Ethyl Nitrile Tetralin [33% solution in dipropylene glycol (Musk Nitrile)] |
| 2 | Hexyloxyacetaldehyde Dimethyl Acetal |
| 1000 | |

The hexyloxyacetonitrile from n-hexanol may be prepared by an alternate method not disclosed in the aforementioned Clarke Patent No. 3,132,179. In this alternate method, n-hexanol is initially chloromethylated to chloromethyl-n-hexyl ether as follows:

$$CH_3—(CH_2)_5—OH + HCHO + HCl \rightarrow CH_3—(CH_2)_5—O—CH_2Cl$$

102 g of n-hexanol (1 mol) are combined with an aqueous solution of 36 g of formaldehyde gas (1.2 mol). The mixture is slowly agitated, cooled to 1°-5° C and saturated with hydrogen chloride gas. The cold mixture is slowly raised to room temperature. After about 15 hours the mixture is separated and the aqueous portion is discarded. The organic portion is diluted with 50 ml of an inert solvent such as ether, hexane or toluene. The solution is washed twice with 100 ml of ice water. The solvent is removed by distillation under vacuum. The desired chloromethyl-n-hexyl ether is obtained by fractional distillation at a convenient vacuum (between 5-10 mm). The yield is about 55-65% of the theoretical.

The hexyloxyacetonitrile is obtained by reaction with cuprous cyanide as follows:

$$CH_3—(CH_2)_5—O—CH_2—Cl + CuCN \rightarrow CH_3—(CH_2)_5—O—CH_2—CN + CuCl$$

75 g of chloromethyl-n-hexyl ether (1/2 mol) is added under agitation over a period of 25-30 minutes to 67 g (0.75 mol) of cuprous cyanide. The mixture is agitated and gradually heated over a period of 30 minutes to 100° C. After completion of reaction, the mixture is cooled to 20° - 22° C, diluted with an inert solvent such as ether, and the solid material removed by filtration. The solvent in the liquid portion is removed to recover the hexyloxyacetonitrile. A yield of about 50 - 65% of the theoretical is obtained.

What is claimed is:

1. A perfume composition comprising .1% to 10% by weight of hexyloxyacetonitrile and at least 1% by weight of a perfume component which modifies the olfactory properties of said hexyloxyacetonitrile.

2. A composition of claim 1 comprising at least 1% by weight of hexyloxyacetaldehyde dimethyl acetal.

3. A composition of claim 1 in which the hexyloxyacetonitrile is incorporated in the composition in the form of a solution of dipropylene glycol.

* * * * *

UNITED STATES PATENT OFFICE

CERTIFICATE OF CORRECTION

Patent No. 4,077,916 Dated March 7, 1978

Inventor(s) Kurt Kulka

It is certified that error appears in the above-identified patent and that said Letters Patent are hereby corrected as shown below:

Column 1, equation (II) should read:

$$CH_3 - (CH_2)_5 - O - CH_2Cl + CuCN \longrightarrow$$

$$CH_3 - (CH_2)_5 - O - CH_2 - CN + CuCl$$

Column 3, line 19, the numeral "3" should be inserted in "Parts by Weight" column before "hexyloxyacetaldehyde dimethyl acetal".

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*